US007293847B2

(12) United States Patent
Lee et al.

(10) Patent No.: US 7,293,847 B2
(45) Date of Patent: Nov. 13, 2007

(54) CABINET FOR RECESSED REFRIGERATORS

(75) Inventors: Jae Seung Lee, Kwangiu (KR); Myung Wouk Kim, Kwangiu (KR); Gi Joong Jeong, Kwangiu (KR); Jong Dal Lee, Suwon (KR); Sang-Gyu Jung, Kwangiu (KR); Ji Sick Hwang, Yangsan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 304 days.

(21) Appl. No.: 10/644,961

(22) Filed: Aug. 21, 2003

(65) Prior Publication Data

US 2004/0104654 A1 Jun. 3, 2004

(30) Foreign Application Priority Data

Aug. 31, 2002 (KR) ..... 10-2002-0052255
Oct. 25, 2002 (KR) ..... 10-2002-0065433
Oct. 25, 2002 (KR) ..... 10-2002-0065434
Mar. 29, 2003 (KR) ..... 10-2003-0019844

(51) Int. Cl.
*A47B 96/04* (2006.01)

(52) U.S. Cl. ..... 312/406.2; 312/401

(58) Field of Classification Search ..... 312/400, 312/401, 406, 406.2, 407, 116, 242, 296; 220/592.02; 62/440, 441
See application file for complete search history.

(56) References Cited

U.S. PATENT DOCUMENTS 1,543,349 A 6/1925 Walker
1,685,248 A * 9/1928 Strufe ..... 52/27
1,761,040 A 6/1930 Hull
1,780,425 A 11/1930 Hull
2,450,844 A * 10/1948 Stuart ..... 62/382
2,812,642 A 11/1957 Jacobs
2,815,649 A * 12/1957 Di Angelus et al. ..... 312/408
3,122,899 A 3/1964 Costantini et al.
3,126,716 A 3/1964 Witte
3,178,902 A 4/1965 Costantini et al.

(Continued)

FOREIGN PATENT DOCUMENTS

CA 633899 1/1962

(Continued)

OTHER PUBLICATIONS

EPO Search Report dated Jun. 15, 2004.

(Continued)

*Primary Examiner*—James O. Hansen
(74) *Attorney, Agent, or Firm*—Staas & Halsey LLP

(57) ABSTRACT

A cabinet for recessed refrigerators, which has an integrated single inner casing. The cabinet has an outer casing to define an appearance of the cabinet, the outer casing being a box-shaped body open at the front thereof, and an integrated single inner casing installed in the outer casing, with a predetermined space defined between the inner and outer casings. The integrated single inner casing defines therein at least two storage compartments open at the fronts thereof, with a partition wall formed between the at least two storage compartments to maintain a predetermined gap between the storage compartments. The cabinet has an improved appearance and a stable structure, in addition to reducing the number of elements thereof, and improving assembly efficiency.

10 Claims, 17 Drawing Sheets

U.S. PATENT DOCUMENTS

| | | | | | |
|---|---|---|---|---|---|
| 3,353,314 | A | | 11/1967 | Melcher | |
| 3,405,987 | A | * | 10/1968 | Pulaski | 312/406.2 |
| 3,489,477 | A | * | 1/1970 | Harder, Jr. | 312/236 |
| 3,590,594 | A | | 7/1971 | Arend | |
| 3,620,404 | A | * | 11/1971 | Grasso | 220/477 |
| 3,712,078 | A | | 1/1973 | Maynard et al. | |
| 3,745,786 | A | | 7/1973 | Laughlin et al. | |
| 3,834,176 | A | | 9/1974 | Clarke | |
| 3,835,660 | A | | 9/1974 | Franck | 62/277 |
| 3,893,307 | A | | 7/1975 | Jacobs | |
| 3,984,223 | A | * | 10/1976 | Whistler, Jr. | 62/81 |
| 3,992,171 | A | | 11/1976 | Jenewein | |
| 4,076,350 | A | * | 2/1978 | Crist | 312/242 |
| 4,638,644 | A | | 1/1987 | Gidseg | |
| 4,714,304 | A | | 12/1987 | Sisk et al. | |
| 4,741,175 | A | | 5/1988 | Schulze | |
| 4,776,182 | A | | 10/1988 | Gidseg | |
| 4,822,117 | A | * | 4/1989 | Boston, Jr. | 312/257.1 |
| 4,970,874 | A | * | 11/1990 | Solak et al. | 62/258 |
| 5,086,627 | A | | 2/1992 | Borgen | |
| 5,212,924 | A | | 5/1993 | Finkelstein | |
| 5,284,023 | A | | 2/1994 | Silva et al. | |
| 5,368,381 | A | * | 11/1994 | Mandel | 312/406.2 |
| 5,531,267 | A | | 7/1996 | Ahmed et al. | |
| 5,564,808 | A | * | 10/1996 | Gipson et al. | 312/405 |
| 5,584,551 | A | * | 12/1996 | Jenkins | 312/401 |
| 5,729,997 | A | | 3/1998 | Witsoe | |
| 5,730,516 | A | * | 3/1998 | Vismara | 312/406 |
| 5,826,442 | A | | 10/1998 | Lee | |
| 5,908,229 | A | * | 6/1999 | Wetherholt et al. | 312/406.2 |
| 6,029,411 | A | | 2/2000 | Richardson | |
| 6,036,294 | A | * | 3/2000 | Banicevic et al. | 312/407 |
| 6,056,383 | A | * | 5/2000 | Banicevic et al. | 312/406 |
| 6,070,424 | A | | 6/2000 | Bauman et al. | |
| 6,094,934 | A | * | 8/2000 | Rand et al. | 62/440 |
| 6,122,879 | A | | 9/2000 | Montes | |
| 6,216,410 | B1 | | 4/2001 | Haberman | |
| 6,341,830 | B1 | | 1/2002 | Chun | |
| 6,381,981 | B1 | | 5/2002 | Yaddgo et al. | |
| 6,464,312 | B1 | * | 10/2002 | Tenhundfeld et al. | 312/405 |
| 6,735,976 | B2 | * | 5/2004 | Lee | 62/419 |
| 2002/0093276 | A1 | | 7/2002 | Kawakami | |
| 2002/0117949 | A1 | | 8/2002 | Banicevic et al. | 312/407 |
| 2004/0040338 | A1 | * | 3/2004 | Lee et al. | 62/441 |
| 2004/0041503 | A1 | * | 3/2004 | Lee | 312/406 |
| 2004/0139763 | A1 | * | 7/2004 | Jeong et al. | 62/448 |
| 2004/0144130 | A1 | * | 7/2004 | Jung | 62/513 |
| 2004/0163408 | A1 | * | 8/2004 | Kim et al. | 62/428 |

FOREIGN PATENT DOCUMENTS

| | | |
|---|---|---|
| CH | 435 339 | 5/1967 |
| DE | 1237148 | 3/1967 |
| EP | 0 361 307 | 4/1990 |
| EP | 0 382 963 | 8/1990 |
| EP | 1 079 187 | 2/2001 |
| EP | 1 174 666 A2 | 1/2002 |
| GB | 850555 | 10/1960 |
| JP | 54-68557 | 6/1979 |
| KR | 1999-19291 | 3/1999 |
| KR | 10-288258 | 2/2001 |
| WO | 93/08434 | 4/1993 |

OTHER PUBLICATIONS

U.S. Appl. No. 10/644,937, filed Aug. 21, 2003, Lee et al., Samsung Electronics Co., Ltd.

U.S. Appl. No. 10/687,673, filed Oct. 20, 2003, Gi Joonh Jeong, et al., Samsung Electronics Co., Ltd.

U.S. Appl. No. 10/385,566, filed Mar. 12, 2003, Jae-Seung Lee, Samsung Electronics Co., Ltd.

Patent Abstracts of Japan for Japanese Application Publication No. 2000-65459, published Mar. 3, 2000.

European Search Report dated May 11, 2004 issued in European Application No. 03025146.6-2301-.

* cited by examiner

CABINET FOR RECESSED REFRIGERATORS

CROSS-REFERENCE TO RELATED APPLICATIONS

This application claims the benefit of Korean Patent Application No. 2002-52255, filed Aug. 31, 2002, Korean Patent Application No. 2002-65433, filed Oct. 25, 2002, Korean Patent Application No. 2002-65434, filed Oct. 25, 2002, and Korean Patent Application No. 2003-19844, filed Mar. 29, 2003 in the Korean Intellectual Property Office, the disclosures of which are incorporated herein by reference.

BACKGROUND OF THE INVENTION

1. Field of the Invention

The present invention relates, in general, to recessed refrigerators installed in a wall-recessed manner and, more particularly, to a cabinet for recessed side-by-side refrigerators, which has an integrated single inner casing to define a freezer compartment and a refrigerator compartment therein, and other elements that are structured to be suitable to the integrated single inner casing.

2. Description of the Related Art

As is well known to those skilled in the art, recessed refrigerators are installed in a manner of being recessed in walls of buildings or houses, and typically have large capacities, in comparison with conventional home refrigerators. The recessed refrigerators typically have side-by-side structures, and such recessed refrigerators are called "recessed side-by-side refrigerators". To install a recessed refrigerator in a building or a house, a recess must be positioned at a wall to receive the refrigerator therein. A conventional cabinet for recessed side-by-side refrigerators will be described herein below, with reference to FIGS. 1 to 3.

FIG. 1 is a perspective view of a recessed side-by-side refrigerator 100 with a conventional cabinet. As shown in the drawing, to recess the refrigerator 100 in a wall 10, the wall 10 is provided with a recess at a desired position. Two doors of the refrigerator 100, which are mounted to the cabinet to respectively open and close a freezer compartment 102*a* and a refrigerator compartment 103*a*, are not shown in FIG. 1 to expose the freezer compartment 102*a* and the refrigerator compartment 103*a*, for ease of description. The cabinet of the recessed side-by-side refrigerator 100 includes an outer casing 101, two inner casings 102 and 103, and a cabinet flange 104. The outer casing 101 defines an appearance of the cabinet, that is, the appearance of the recessed side-by-side refrigerator 100. The inner casings 102 and 103 include a first inner casing 102 defining the freezer compartment 102*a* therein, and a second inner casing 103 defining the refrigerator compartment 103*a* therein. The cabinet flange 104 covers a front of the cabinet, which is defined between a front edge of the outer casing 101 and front edges of the two inner casings 102 and 103, and between the front edges of the two inner casings 102 and 103, so that the cabinet flange 104 finishes the front of the cabinet.

FIG. 2 is a sectional view of the conventional cabinet of the recessed side-by-side refrigerator 100, taken along the line A-A of FIG. 1. The cabinet of the recessed side-by-side refrigerator 100 will be described in detail herein below, with reference to FIG. 2.

The outer casing 101 of the cabinet is a box-shaped body open at the front thereof. The first inner casing 102, which is a box-shaped body open at the front thereof, is placed at one side of the interior of the outer casing 101, with predetermined spaces defined between the outer casing 101 and the first inner casing 102, so that the first inner casing 102 defines the freezer compartment 102*a* therein. In the same manner as that described for the first inner casing 102, the second inner casing 103 is a box-shaped body open at the front thereof, which is placed at an other side of the interior of the outer casing 101, with predetermined spaces defined between the first and second inner casings 102 and 103, and between the outer casing 101 and the second inner casing 103, so that the second inner casing 103 defines the refrigerator compartment 103*a* therein. In the above-mentioned cabinet, a partition wall "A" is positioned between the first and second inner casings 102 and 103 to provide a thermal insulation between the freezer and refrigerator compartments 102*a* and 103*a*.

In the above-mentioned cabinet, the cabinet flange 104 covers the front of the cabinet, which is defined between the front edge of the outer casing 101 and the front edges of the two inner casings 102 and 103. The cabinet flange 104 also covers the front of the partition wall "A". The structure of the conventional cabinet flange 104 is shown in FIG. 3.

Each of the first and second inner casings 102 and 103 is fabricated with three walls, that is, two sidewalls and one rear wall. In each of the first and second inner casings 102 and 103, the three walls are assembled together along junction edges thereof into a single box-shaped body through a caulking process, as shown at the portion "I" of FIG. 2. A sealing member 105 is provided along each of the caulked junctions of the walls of the first and second casings 102 and 103, to prevent a leakage of urethane foam through the caulked junctions. The urethane foam fills the predetermined spaces between the outer casing 101 and the first and second inner casings 102 and 103, and fills a space inside the partition wall "A" positioned between the first and second inner casings 102 and 103. The urethane foam fills the spaces between the inner and outer casings and the space of the partition wall after the inner and outer casings are fabricated into a single body.

A hot pipe 106 and a magnet 107 are provided at the front of the cabinet fabricated with the outer and inner casings 101, 102, and 103, such that the hot cover 106 and the magnet 107 are covered with the cabinet flange 104. The hot pipe 106 is arranged along the front edge of the cabinet to prevent a formation of condensation at the front of the cabinet. The hot pipe 106 is attached to the cabinet flange 104 by use of both a clip pipe 106*a* and a double-faced adhesive tape. The magnet 107 is arranged at the front of the cabinet to allow the two doors (not shown) having magnets to be magnetically attracted to the front of the cabinet, so that the two doors are magnetically closed to the front of the cabinet. The magnet 107 is attached to the cabinet flange 104 by use of a double-faced adhesive tape.

But the conventional cabinet for the recessed side-by-side refrigerators is problematic as follows.

First, a longitudinal step and a longitudinal gap are undesirably positioned along each junction line between the cabinet flange 104 and the first and second inner casings 102 and 103, as shown at the portion "II" of FIG. 2. Due to the step and the gap, the conventional cabinet for the recessed side-by-side refrigerators has an inferior front appearance, reducing the quality of the refrigerators.

Second, in each of the first and second inner casings 102 and 103, the three walls are assembled together along the junction edges thereof into a single box-shaped body through the caulking process, as described above with reference to the portion "I" of FIG. 2. The caulking process of assembling the three walls of each of the first and second inner casings 102 and 103 into a single body complicates a process of assembling the cabinet, thus reducing work efficiency, and increasing the cost of materials, thereby increasing a production cost of the cabinets.

Third, the sealing member 105, which is provided along each of the caulked junctions of the walls of the first and second casings 102 and 103, degrades the appearance of the cabinet.

SUMMARY OF THE INVENTION

Accordingly, it is an aspect of the present invention to provide a cabinet for the recessed refrigerators, which has an integrated single inner casing to define a freezer compartment and a refrigerator compartment therein, and other elements of which are structured to be suitable to the integrated single inner casing.

Additional aspects and advantages of the invention will be set forth in part in the description which follows and, in part, will be obvious from the description, or may be learned by practice of the invention.

The foregoing and/or other aspects of the present invention are achieved by providing a cabinet for recessed refrigerators, comprising: an outer casing to define an appearance of the cabinet, the outer casing being a box-shaped body open at a front thereof; and an integrated single inner casing installed in the outer casing, with a predetermined space defined between the inner and outer casings, the integrated single inner casing defining therein at least two storage compartments open at respective fronts thereof, with a partition wall between the at least two storage compartments to maintain a predetermined gap between the storage compartments.

According to one aspect, the inner casing has a front flange that extends from a front edge of the inner casing toward a front edge of the outer casing to cover a front of the space defined between the inner and outer casings.

According to one aspect, the cabinet additionally has at least one partition wall structure provided in back of a front end surface of the partition wall.

According to one aspect, the cabinet additionally has a support member installed in the partition wall at a position in back of the at least one partition wall structure to support the partition wall structure.

According to one aspect, the at least one partition wall structure has a hot pipe.

According to one aspect, the at least one partition wall structure has one of at least one magnet or at least one magnetic material.

Aspects of the present invention are also achieved by providing a cabinet for recessed refrigerators, comprising: an outer casing to define an appearance of the cabinet, the outer casing being a box-shaped body open at a front thereof; an integrated single inner casing installed in the outer casing, with a predetermined space defined between the inner and outer casings, the integrated single inner casing defining therein at least one storage compartment open at a front thereof; and a cabinet chassis mounted along an outer surface of the outer casing to finish front edges of the inner and outer casings.

According to one aspect, the inner casing has a front flange that extends from the front edge of the inner casing toward the front edge of the outer casing to cover a front of the space defined between the inner and outer casings, and the cabinet chassis finishes both the front flange of the inner casing and the front edge of the outer casing.

According to one aspect, the cabinet chassis has a stop flange that extends from the cabinet chassis toward the front flange of the inner casing to support the front flange of the inner casing.

According to one aspect, the cabinet chassis has a bent part that is bent toward a wall to cover a gap between the cabinet and the wall, wherein the wall has a recess to receive a recessed refrigerator therein.

Aspects of the present invention are also achieved by providing a cabinet for recessed refrigerators, comprising: an outer casing to define an appearance of the cabinet, the outer casing being a box-shaped body open at a front thereof; and an integrated single inner casing installed in the outer casing, with a predetermined space defined between the inner and outer casings, the integrated single inner casing defining therein at least one storage compartment open at a front thereof, with a front flange extending from a front edge of the inner casing toward a front edge of the outer casing to cover a front of the space defined between the inner and outer casings.

According to one aspect, the cabinet additionally has at least one inter-casing structure provided in the space defined between the inner and outer casings at a position adjacent to the front flange of the inner casing.

According to one aspect, the outer casing has a support flange that extends toward the inner casing adjacent to the at least one inter-casing structure to support the inter-casing structure.

According to one aspect, the at least one inter-casing structure has a hot pipe.

According to one aspect, the at least one inter-casing structure has at least one magnet or at least one magnetic member made of magnetic material.

According to one aspect, the at least one inter-casing structure has a sealing member to seal between the front flange of the inner casing and the support flange of the outer casing.

Aspects of the present invention are also achieved by providing a cabinet for recessed refrigerators, including: an outer casing to define an appearance of the cabinet, the outer casing being a box-shaped body open at a front thereof; an integrated single inner casing installed in the outer casing, with a predetermined space defined between the inner and outer casings, the integrated single inner casing defining therein at least one storage compartment open at a front thereof; a front flange extending from a front edge of the inner casing toward a front edge of the outer casing to cover a front of the space defined between the inner and outer casings; and a support flange extending from the front edge of the outer casing toward the storage compartment of the inner casing adjacent to the front flange of the inner casing, the support flange being made of a magnetic material.

According to one aspect, the cabinet additionally has a sealing member interposed between the front flange of the inner casing and the support flange of the outer casing.

According to one aspect, the cabinet additionally has a hot pipe provided adjacent to the support flange of the outer casing in the predetermined space defined between the inner and outer casings.

Aspects of the present invention are also achieved by providing a cabinet for recessed refrigerators, including: an outer casing to define an appearance of the cabinet, the outer casing being a box-shaped body open at a front thereof; an integrated single inner casing installed in the outer casing, with a predetermined space defined between the inner and outer casings, the integrated single inner casing defining therein at least one storage compartment open at a front thereof; a front flange extending from a front edge of the inner casing toward a front edge of the outer casing to cover a front of the space defined between the inner and outer casings; and a support flange extending from the front edge of the outer casing toward the storage compartment of the inner casing adjacent to the front flange of the inner casing, with a gap defined between the front flange of the inner casing and the support flange of the outer casing, the support flange being also bent at a first location toward the front flange of the inner casing, and being, bent at a second location farther away from the outer casing than the first location, toward the storage compartment of the inner casing, thus forming a doubly bent part, the doubly bent part of the support flange being made of a magnetic material.

According to one aspect, the cabinet additionally has a hot pipe provided in the gap defined between the support flange of the outer casing and the front flange of the inner casing, such that the hot pipe is supported by the support flange.

According to one aspect, the cabinet additionally has a sealing member interposed between the front flange of the inner casing and the doubly bent part of the support flange of the outer casing.

According to one aspect, the cabinet additionally has a cabinet chassis to finish both the front flange of the inner casing and the front edge of the outer casing, and to plug the gap defined between the support flange of the outer casing and the front flange of the inner casing.

Aspects of the present invention are also achieved by providing a cabinet for recessed refrigerators, including: an outer casing to define an appearance of the cabinet, the outer casing being a box-shaped body open at a front thereof; an integrated single inner casing installed in the outer casing, with a predetermined space defined between the inner and outer casings, the integrated single inner casing defining therein at least two storage compartments open at fronts thereof, with a partition wall formed between the at least two storage compartments to maintain a predetermined gap between the storage compartments; at least one partition wall structure provided in the partition wall adjacent to a front end surface of the partition wall; a support member installed in the partition wall at a position adjacent to the partition wall structure to support the at least one partition wall structure; and a support panel to support the support member.

According to one aspect, the support panel is installed in the at least one partition wall at a position between a rear surface of the support member and an inner surface of a rear wall of the outer casing.

According to one aspect, the support panel has at least one opening.

According to one aspect, the support panel is placed in the at least one partition wall at a position eccentric to the at least one partition wall, nearer to one of the at least two storage compartments, which has a lower temperature.

According to one aspect, the at least one partition wall structure has at least one of a hot pipe and a magnet.

Aspects of the present invention are also achieved by providing a cabinet for recessed refrigerators, including: an outer casing to define an appearance of the cabinet, the outer casing being a box-shaped body open at a front thereof; an integrated single inner casing installed in the outer casing, with a predetermined space defined between the inner and outer casings, the integrated single inner casing defining therein at least two storage compartments open at fronts thereof, with a partition wall formed between the at least two storage compartments to maintain a predetermined gap between the storage compartments; at least one partition wall structure provided in the partition wall adjacent to a front end surface of the partition wall; a support member installed in the partition wall at a position adjacent to the partition wall structure to support the partition wall structure; and at least one sealing member provided between the support member and the inner casing.

According to one aspect, the cabinet additionally has a support panel to support the support member.

According to one aspect, the at least one partition wall structure has at least one of a hot pipe and a magnet.

Aspects of the present invention are also achieved by providing a cabinet for recessed refrigerators, including: an outer casing to define an appearance of the cabinet, the outer casing being open at a front thereof and stepped at a top thereof to form a lower step at a front area of the top; an integrated single inner casing installed in the outer casing, with a predetermined space defined between the inner and outer casings, the integrated single inner casing defining therein at least one storage compartment open at a front thereof; and a cover housing provided on the lower step to define a machine room.

According to one aspect, the cabinet additionally has a cabinet chassis mounted along both an outer surface of the outer casing and the cover housing to finish a front of the cabinet.

According to one aspect, the inner casing has a front flange that extends from a front edge of the inner casing toward a front edge of the outer casing to cover a front of the space defined between the inner and outer casings, and the cabinet chassis has a stop flange that extends from the cabinet chassis toward the front flange of the inner casing and the cover housing to support the front flange of the inner casing and a front of the cover housing.

According to one aspect, the chassis has a bent part which is bent toward a wall so as to cover a gap between the cabinet and the wall having a recess to receive a recessed refrigerator therein.

According to one aspect, the cabinet chassis is mounted to the cover housing by use of an L-shaped bracket provided at each of two corners of a front of the cover housing.

According to one aspect, the cabinet further includes an intermediate chassis provided to finish a front of a space defined between the cover housing and the at least one storage compartment.

According to one aspect, the intermediate chassis is interposed, at a first end thereof, between the cover housing and the outer casing, and is bent at a second end thereof toward a lower edge of the cover housing to cover the lower edge of the cover housing.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
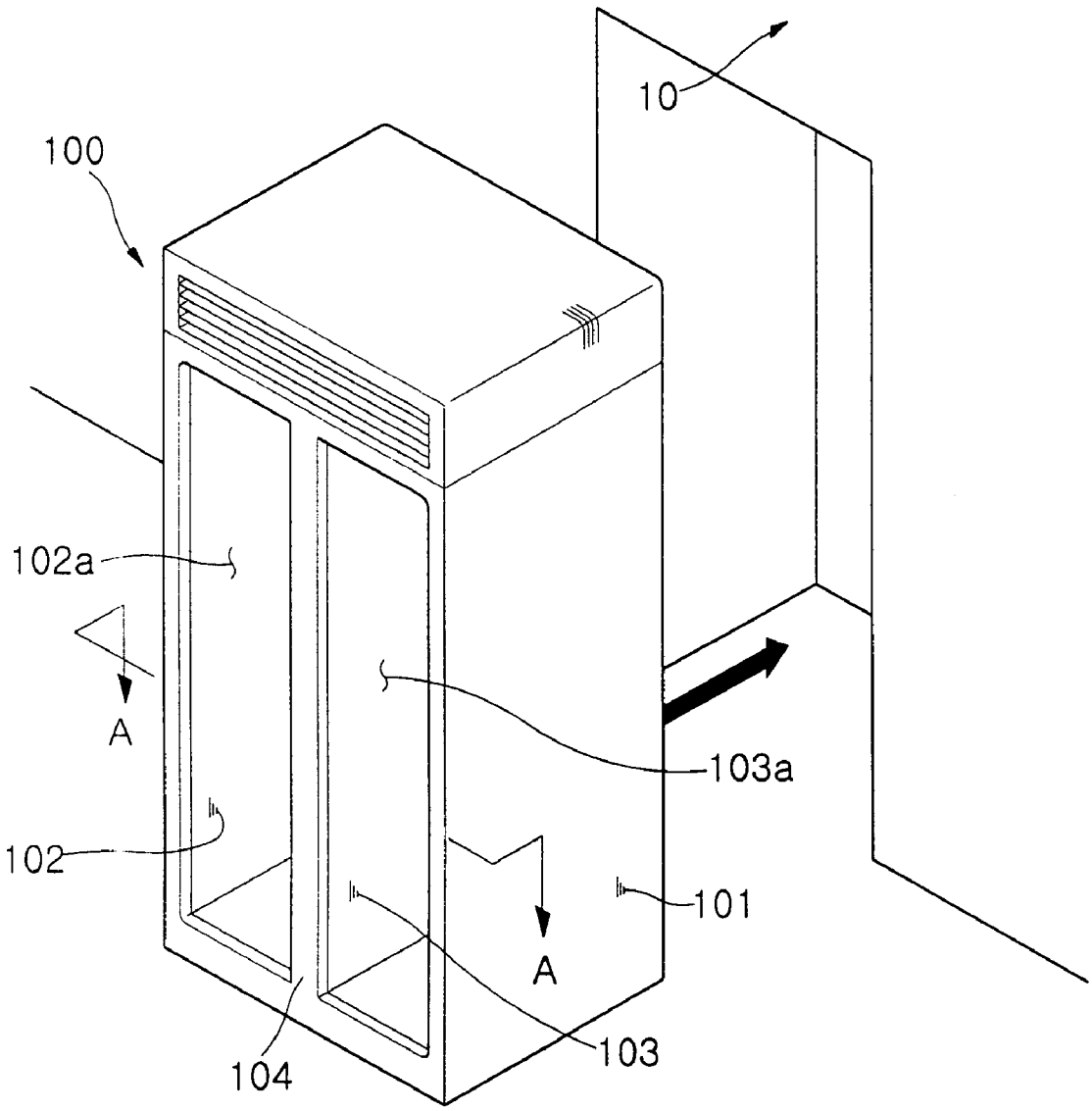
FIG. 1 (PRIOR ART)
FIG. 1 is a perspective view of a recessed side-by-side refrigerator with a conventional cabinet.
Figure 2:
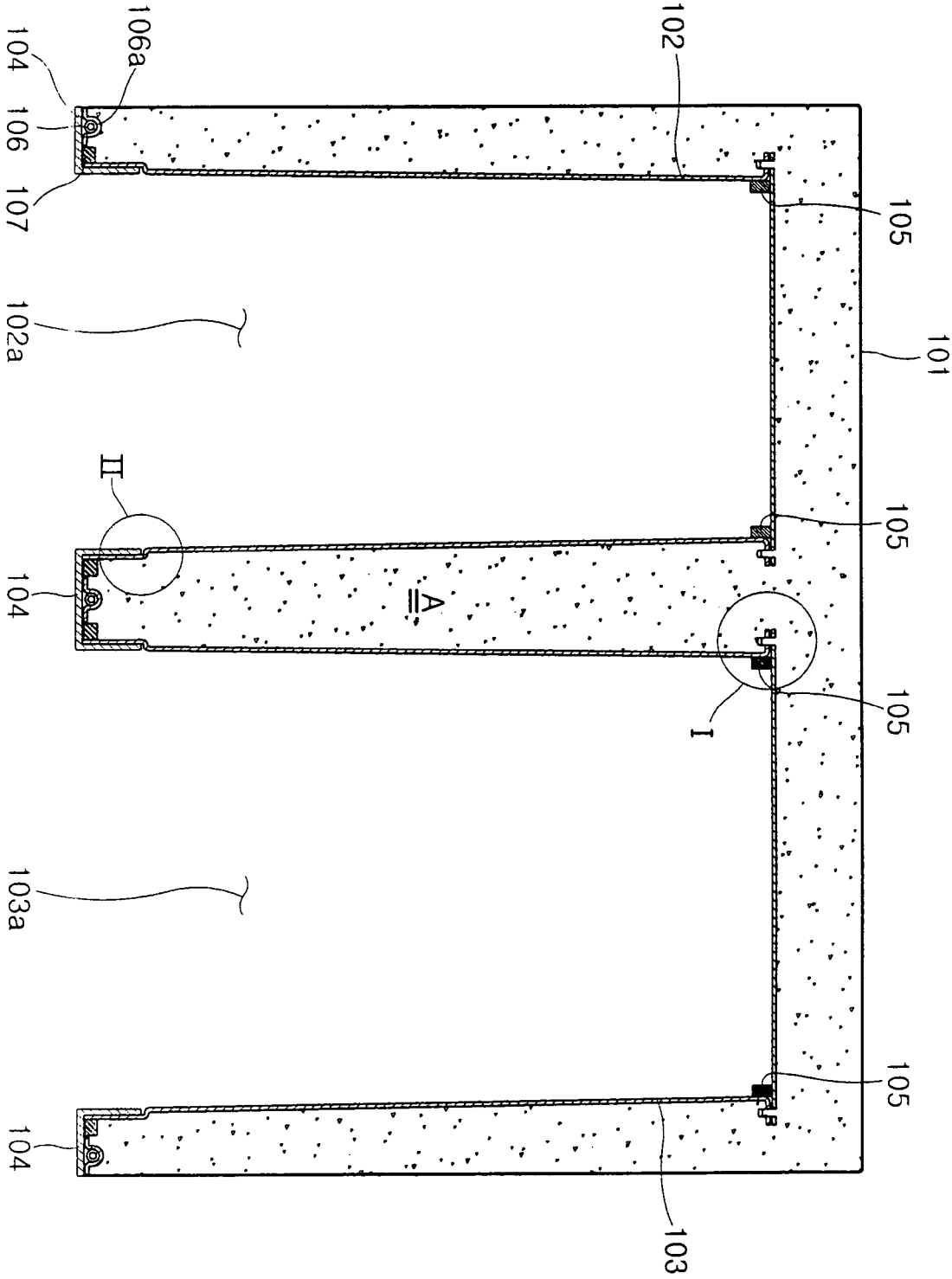
FIG. 2 (PRIOR ART)
FIG. 2 is a sectional view of the conventional cabinet of FIG. 1, taken along the line A-A.
Figure 3:
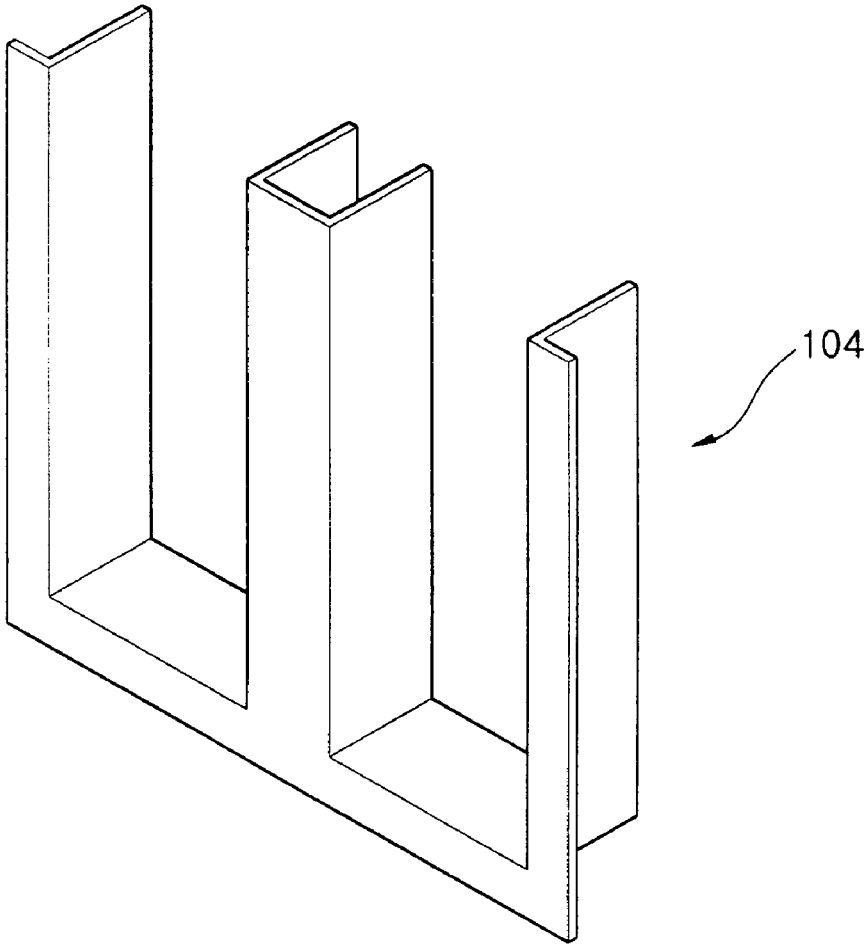
FIG. 3 (PRIOR ART)
FIG. 3 is a perspective view of a cabinet flange of the conventional cabinet of FIG. 1, taken along the line A-A.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 4:
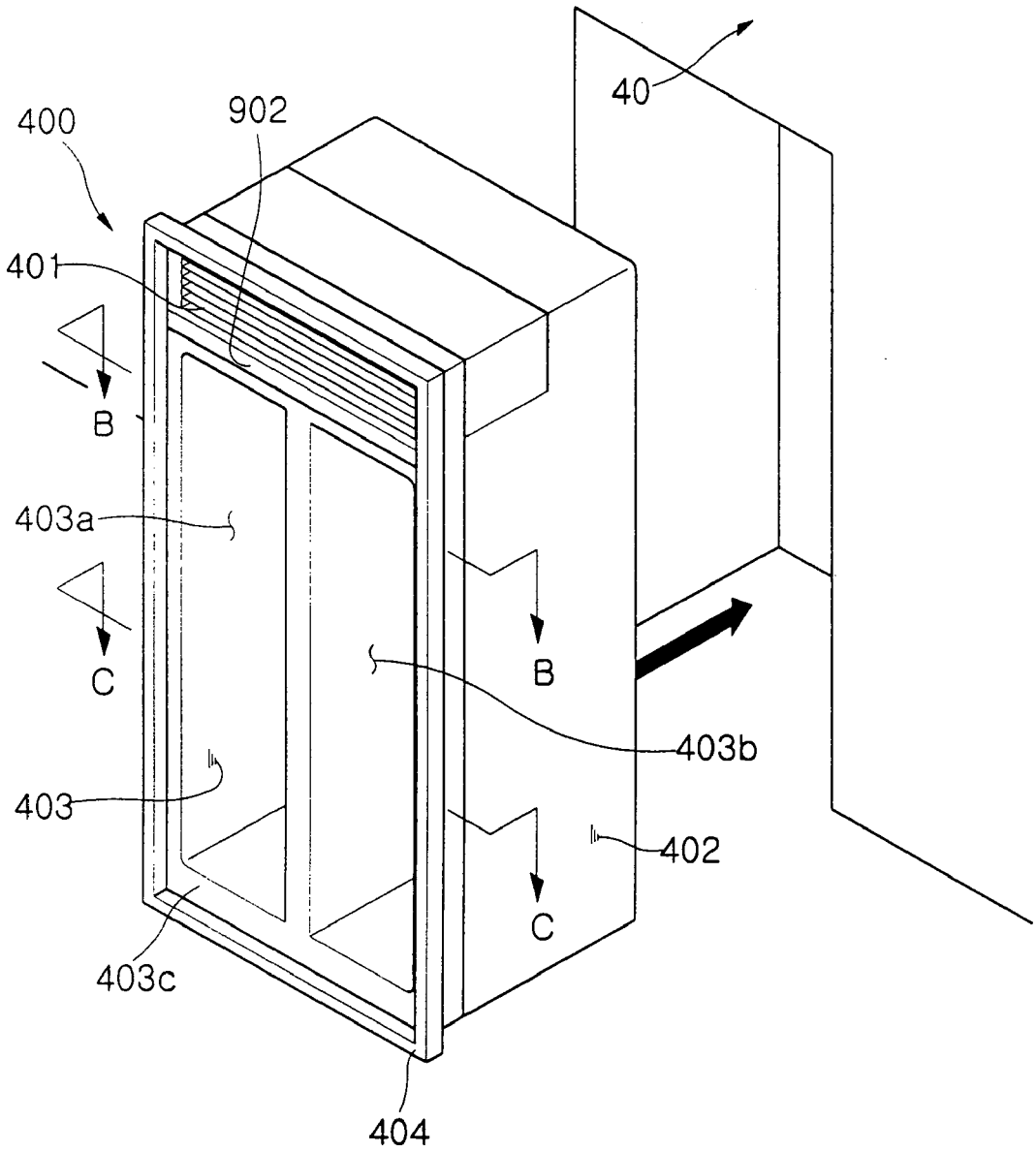
FIG. 4 is a perspective view of a recessed side-by-side refrigerator with a cabinet, according to a first embodiment of the present invention.

FIG. 4 is a perspective view of a recessed side-by-side refrigerator 400 with a cabinet, according to a first embodiment of the present invention.

As shown in the drawing, to recess the refrigerator 400 in a wall 40, the wall 40 is provided with a recess at a desired position. The cabinet of the refrigerator 400 has a machine room 401 at a top thereof, and two storage compartments, that is, a freezer compartment 403*a* and a refrigerator compartment 403*b*, at positions under the machine room in a side-by-side arrangement. Two doors of the refrigerator 400, which are mounted to the cabinet to respectively open and close the freezer compartment 102*a* and the refrigerator compartment 103*a*, are not shown in FIG. 4 to expose the freezer compartment 403*a* and the refrigerator compartment 403*b*, for ease of description. The cabinet of the recessed side-by-side refrigerator 400 includes an outer casing 402, an integrated single inner casing 403, and a cabinet chassis 404. The outer casing 402 defines an appearance of the cabinet, that is, an appearance of the recessed side-by-side refrigerator 400. The outer casing 402 is a box-shaped body open at a front thereof. The integrated single inner casing 403 defines therein the freezer compartment 403*a* and the refrigerator compartment 403*b*, such that the freezer and refrigerator compartments 403*a* and 403*b* are separated from each other. The cabinet chassis 404 is provided around a front edge of the cabinet, so that the cabinet chassis 404 finishes front edges of the outer and inner casings 402 and 403, and covers a gap between the cabinet and the wall 40 having the recess to receive the refrigerator 400 therein. The cabinet chassis 404 thus finishes a front appearance of the refrigerator 400 recessed in the recess of the wall 40.

Figure 5:
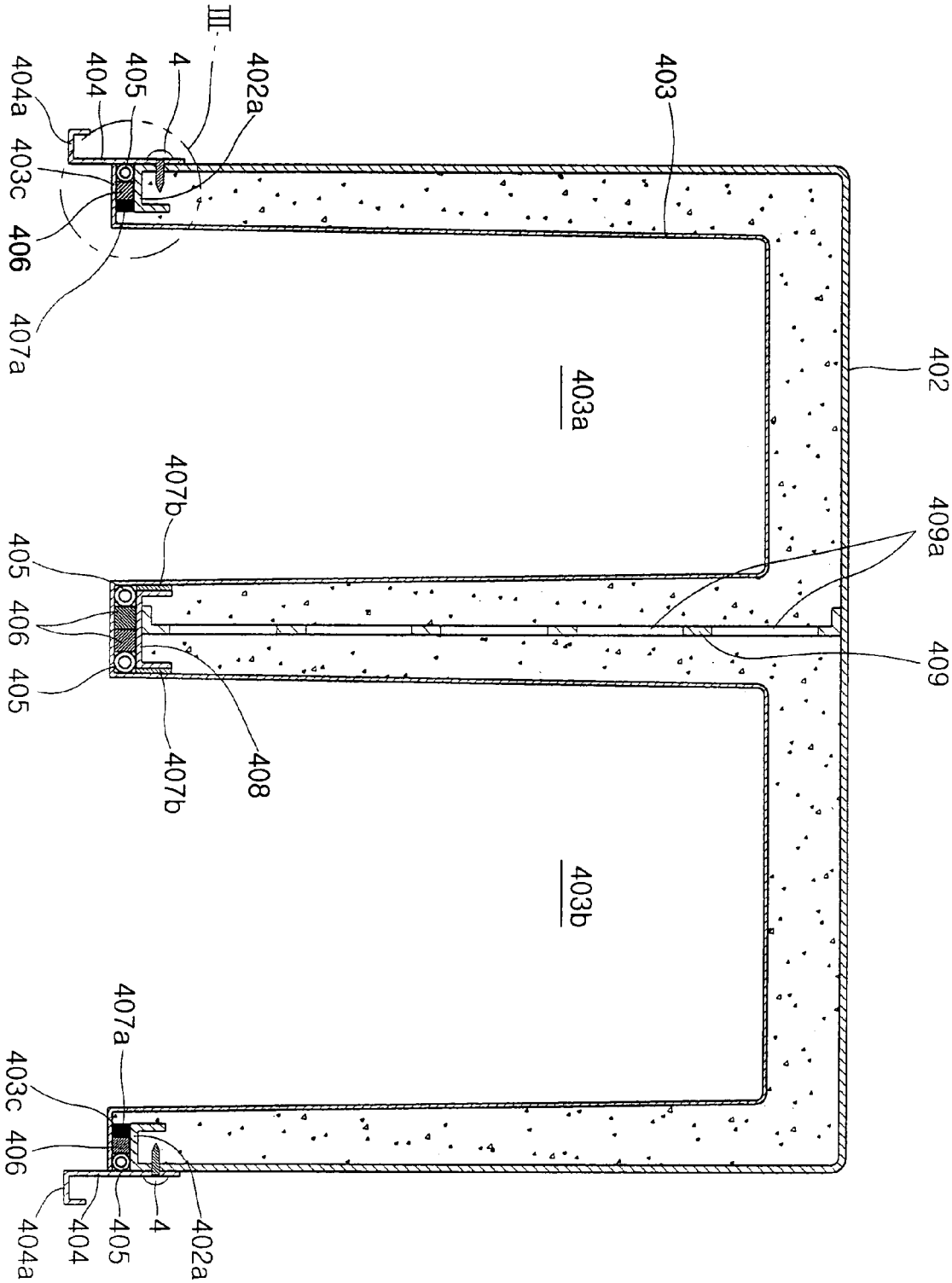
FIG. 5 is a sectional view of the cabinet of FIG. 4, taken along the line B-B.

FIG. 5 is a sectional view of the cabinet of the recessed side-by-side refrigerator 400, taken along the line B-B of FIG. 4. As shown in the drawing, the inner casing 403 has a front flange 403*c*, which extends perpendicularly from the front edge of the inner casing 403 toward a front edge of the outer casing 402 to cover the front of a space defined between the outer and inner casings 402 and 403. The outer casing 402 has a support flange 402*a* that extends perpendicularly from the front edge of the outer casing 402 toward the freezer and refrigerator compartments 403*a* and 403*b*, respectively, in back of the front flange 403*c* of the inner casing 403, with parallel gaps "B" defined on both sides of the refrigerator 400, between the front flange 403*c* and the support flange 402*a* (see FIG. 9A).

In addition to the outer casing 402, the inner casing 403, and the cabinet chassis 404, the cabinet of the recessed side-by-side refrigerator 400 also has hot pipes 405, magnets 406, and first sealing members 407*a*, as elements of inter-casing structures that are provided along the gaps "B" in back of the front flange 403*c* of the inner casing 403. In the inter-casing structure, the hot pipes 405 are arranged along the gaps "B" between the front flange 403*c* and the support flange 402*a* to prevent a formation of condensation at a front surface of the front flange 403*c*. The magnets 406 are arranged adjacent to the hot pipes 405 to allow the two doors (not shown), having magnets, to be magnetically attracted to the front flange 403*c* of the inner casing 403, so that the two doors are magnetically closed to the front of the cabinet. The first sealing members 407*a* are arranged along the gaps "B" to seal the gaps "B", and thereby prevent a leakage of urethane foam, which fills a space between the outer casing 402 and the inner casing 403. The urethane foam fills the space between the inner and outer casings after the inner and outer casings are fabricated into a single body.

In the cabinet, a pair of hot pipes 405 and a pair of magnets 406 are also arranged in back of a front end surface of a partition wall "C" (see FIG. 7), which is positioned by the inner casing 403 at an intermediate position between the freezer and refrigerator compartments 403*a* and 403*b*. In the partition wall "C", the hot pipes 405 and the magnets 406 constitute a partition wall structure. That is, the hot pipes 405 are arranged in back of the front end surface of the partition wall "C" to prevent a formation of condensation at the front end surface of the partition wall "C". The magnets 406 are arranged adjacent to the hot pipes 405 in back of the front end surface of the partition wall "C" to allow the two doors (not shown) to be magnetically attracted to the front end surface of the partition wall "C", and thereby magnetically closed to the front end surface of the partition wall "C". A support member 408 with side edges is vertically installed in the partition wall "C" at a position in back of the hot pipes 405 and the magnets 406, thus supporting both the hot pipes 405 and the magnets 406 in the partition wall "C".

In the partition wall "C", second sealing members 407*b* are interposed between each side edge of the support member 408 and the inner casing 403, thus sealing the junction between the support member 408 and the inner casing 403. A support panel 409 is vertically installed in the partition wall "C" at a position between a rear surface of the support member 408 and an inner surface of a rear wall of the outer casing 402, such that the support panel 409 is perpendicular to the support member 408. The support panel 409 supports the support member 408 in the partition wall "C".

The construction of the cabinet of the recessed side-by-side refrigerator 400 according to the present invention will be described in more detail.

Figure 6:
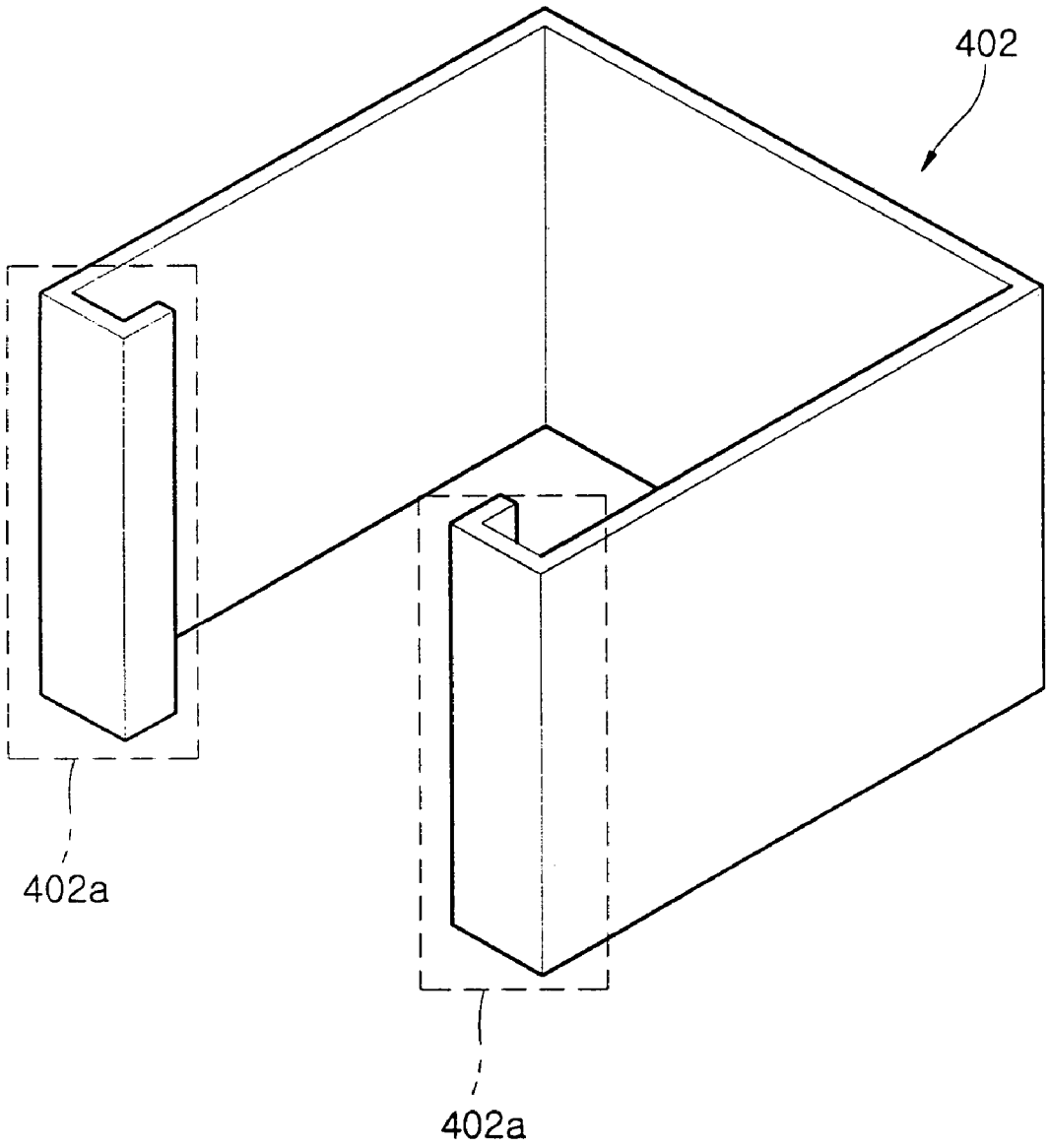
FIG. 6 is a perspective view of an outer casing of the cabinet of FIG. 4, taken along the lines B-B and C-C.

The outer casing 402 (see FIG. 6), which defines the appearance of the cabinet, that is, the appearance of the recessed side-by-side refrigerator 400, is shown in detail in FIG. 6. FIG. 6 is a perspective view of the outer casing 402 of the cabinet, taken along the lines B-B and C-C of FIG. 4. As shown in the drawing, the outer casing 402 has the support flange 402*a* to support both the hot pipes 405 and the magnets 406. In the embodiment shown in FIG. 6, the support flange 402*a* is primarily bent from the front edge of the outer casing 402 toward the inner casing 403, and is secondarily bent rearward, so that the support flange 402*a* has a doubly bent structure which strengthens the support flange 402*a*.

Figure 7:
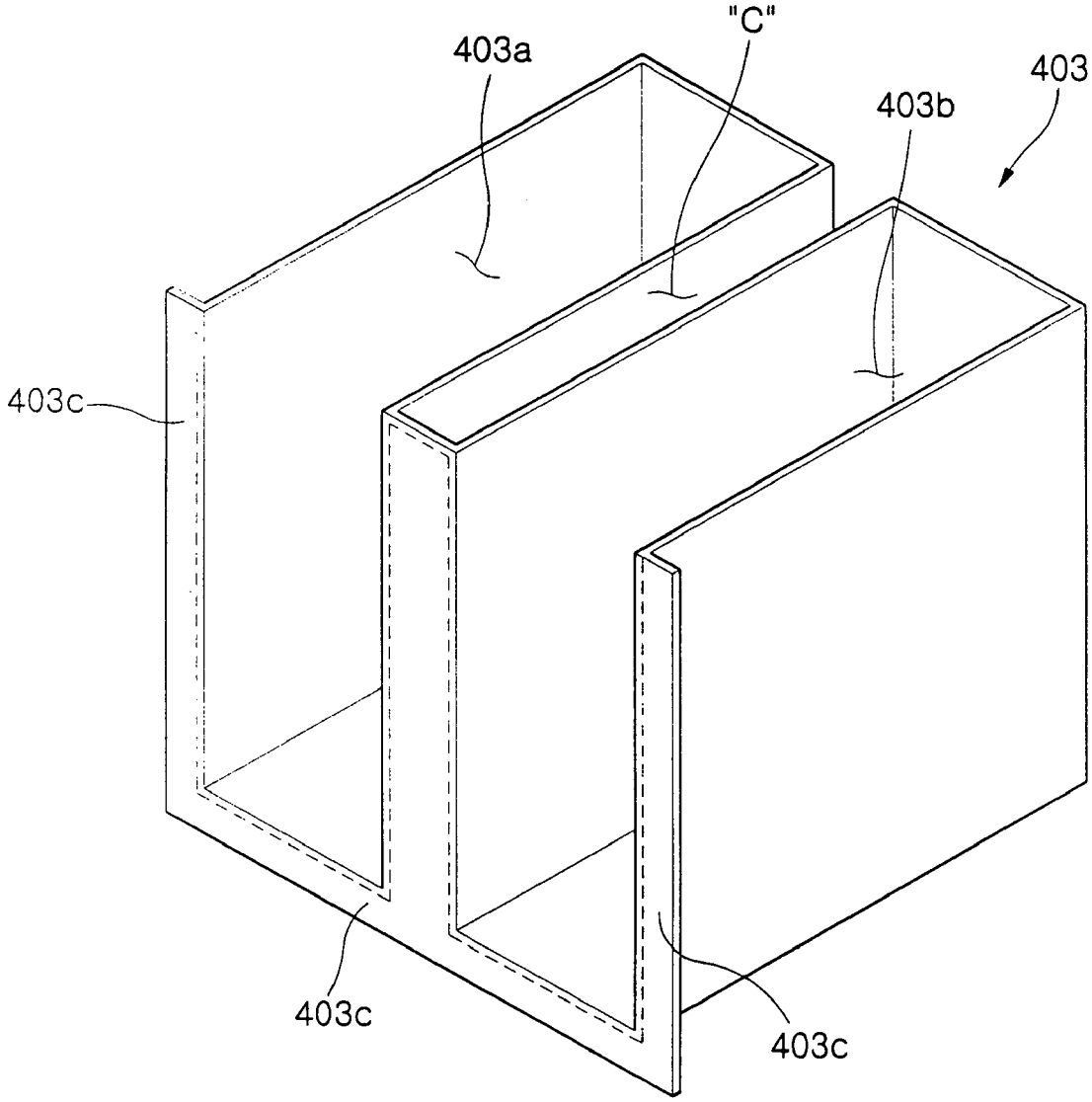
FIG. 7 is a perspective view of an integrated single inner casing of the cabinet of FIG. 4, taken along the line B-B.

FIG. 7 is a perspective view of the inner casing 403 of the cabinet, taken along the line B-B of FIG. 4. As shown in the drawing, the inner casing 403, which defines therein the two storage compartments, that is, the freezer compartment 403*a* and the refrigerator compartment 403*b*, has the integral partition wall "C" maintaining a predetermined interval between the freezer and refrigerator compartments 403*a* and 403*b* to thermally isolate the freezer and refrigerator compartments 403*a* and 403*b* from each other. As best seen in FIG. 7, the inner casing 403 has the front flange 403*c* that extends perpendicularly from the front edge of the inner casing 403 toward the front edge of the outer casing 402 to cover the front of the space defined between the outer and inner casings 402 and 403.

Figure 8A:
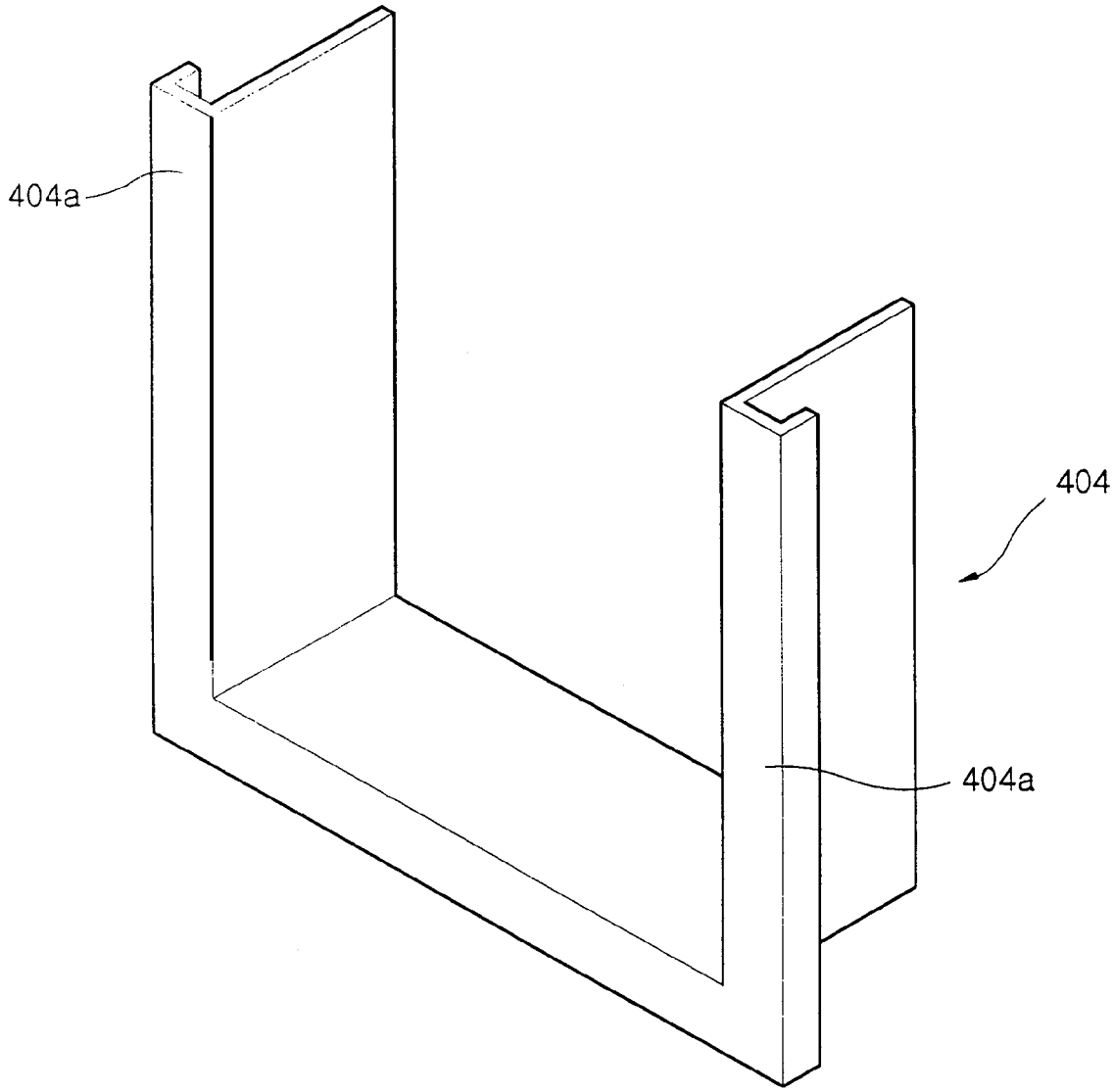
FIG. 8A is a perspective view of a cabinet chassis of the cabinet of FIG. 4, taken along the line B-B.

FIG. 8A is a perspective view of the cabinet chassis 404, taken along the line B-B of FIG. 4. As shown in FIGS. 5 and 8A, the cabinet chassis 404 is positioned around the front edge of the cabinet so that the cabinet chassis 404 covers the gap between the cabinet and the wall 40 having the recess to receive the refrigerator 400 therein. The cabinet chassis 404 thus finishes the front appearance of the refrigerator 400 recessed in the recess of the wall 40. The cabinet chassis 404, mounted along the outer surface of the front edge of the outer casing 402, extends forward from the outer casing 402 by a predetermined distance, is primarily bent outward at a front edge thereof, and is secondarily bent rearward, thus having a doubly bent part 404*a* to cover the gap between the cabinet and the wall 40.

Figure 8B:
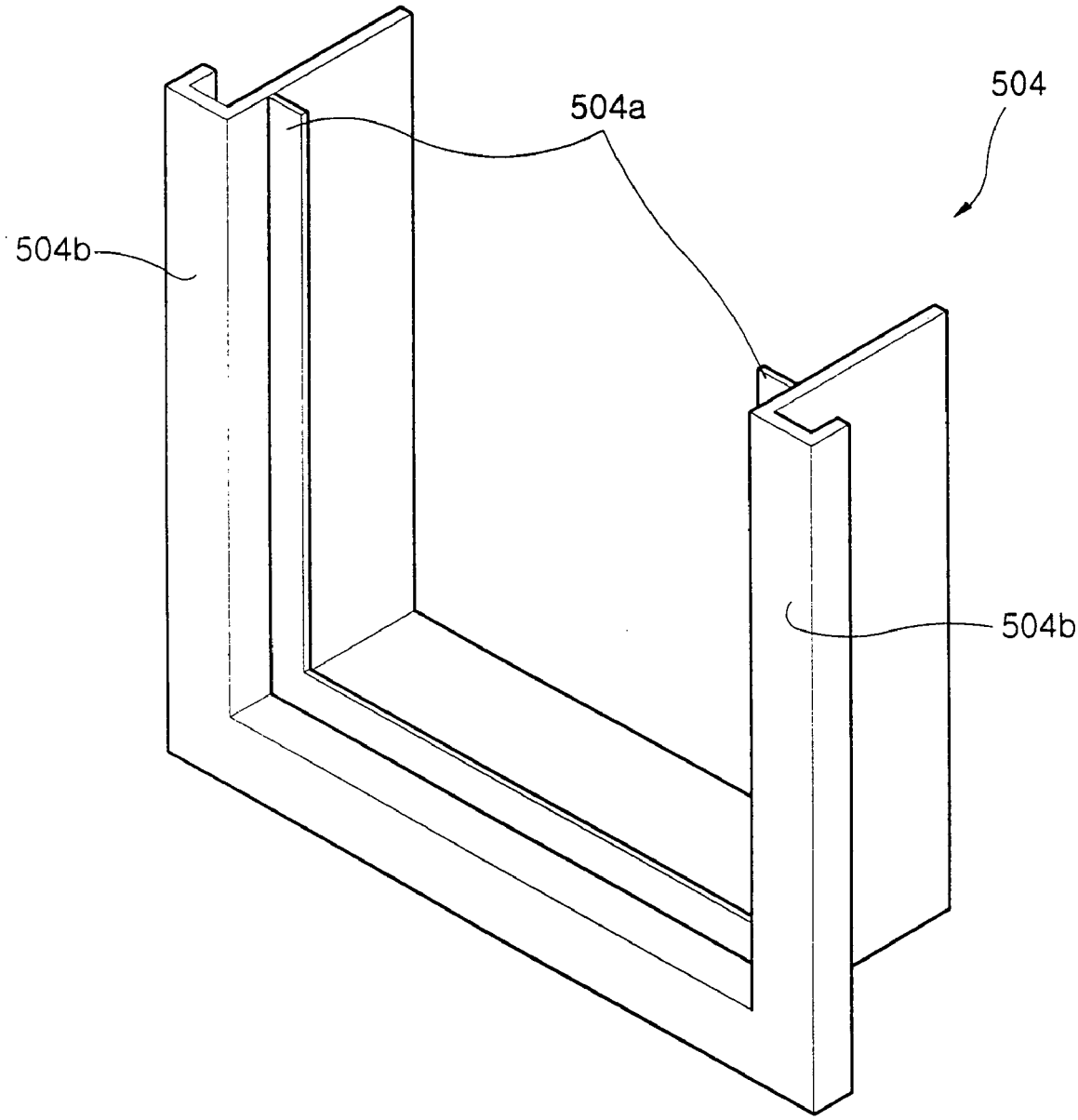
FIG. 8B is a perspective view of a cabinet chassis of the cabinet, according to another embodiment of the present invention.

FIG. 8B is a perspective view of the cabinet chassis 504, according to another embodiment of the present invention. As shown in the drawing, the general shape of the cabinet chassis 504 according to this other embodiment remains the same as that described for the cabinet chassis 404 according to the first embodiment, but a stop flange 504*a* is positioned along an inner surface of the cabinet chassis 504. The stop flange 504*a* supports the front flange 403*c* of the integrated single inner casing 403 at the outside of the front flange 403*c* when the cabinet is completely assembled, so that the stop flange 504*a* prevents the front flange 403*c* of the inner casing 403 from being thrust forward or deformed. In FIG. 8B, the doubly bent part of the cabinet chassis 504, which covers the gap between the cabinet and the wall 40 having the recess to receive the refrigerator 400 therein, is designated by the reference numeral 504*b*, and is substantially similar to the doubly bent part 404*a* of FIG. 8A.

Figure 9A:
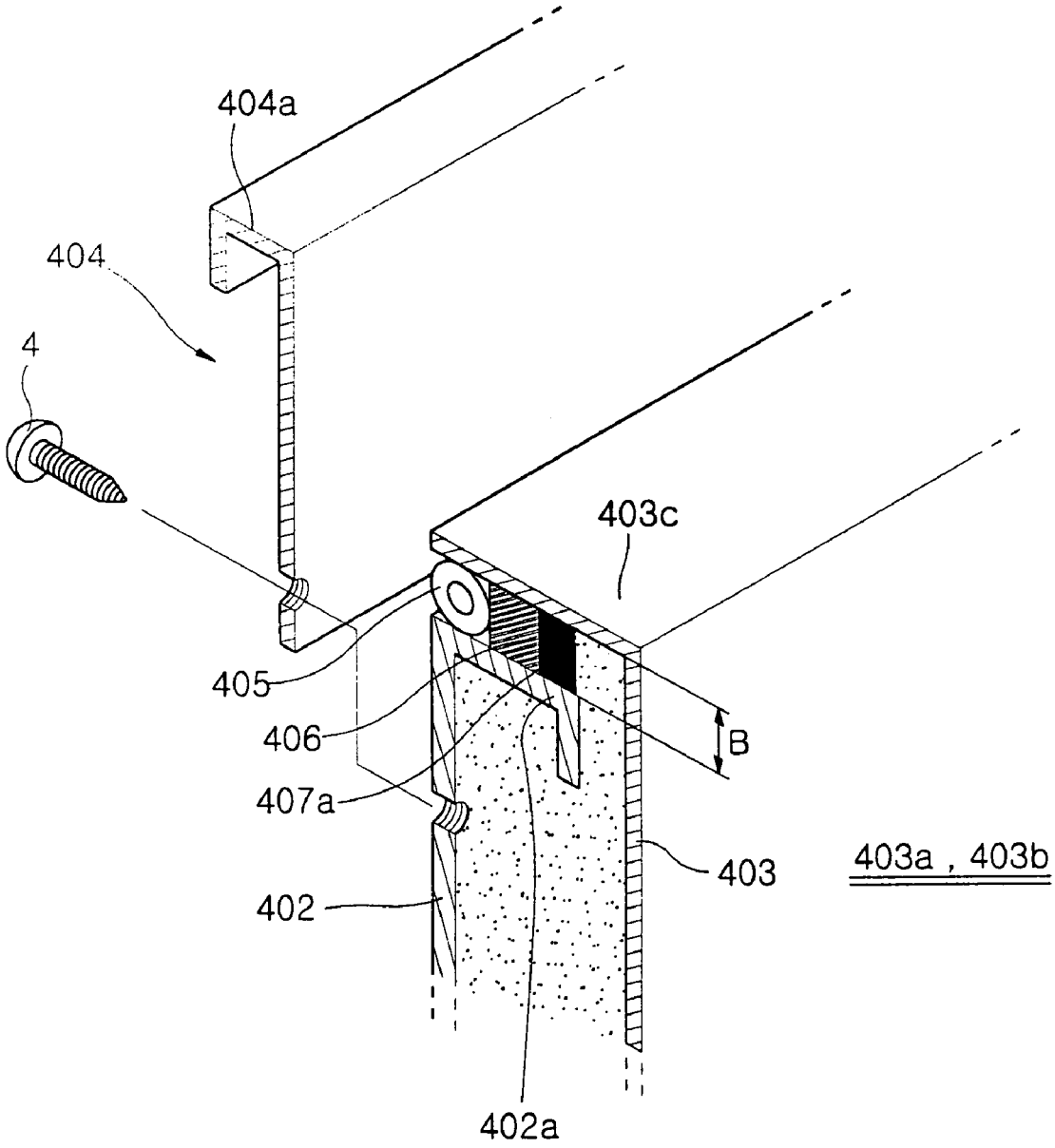
FIG. 9A is an exploded perspective view of the portion III of FIG. 5 to show a construction of an inter-casing structure provided between the inner and outer casings.

FIG. 9A is an exploded perspective view of the portion III of FIG. 5 to show the inter-casing structure provided between the outer casing 402 and the inner casing 403, according to the first embodiment of the present invention. As shown in FIGS. 5 and 9A, the gap "B" is defined between the front flange 403*c* of the inner casing 403 and the support flange 402*a* of the outer casing 402. In addition, the hot pipe 405, the magnet 406, and the first sealing member 407*a* are provided along the gap "B" in back of the front flange 403*c* of the inner casing 403, such that the hot pipe 405, the magnet 406, and the first sealing member 407*a* are supported by the support flange 402*a* to be in close contact with the front flange 403*c* of the inner casing 403. In the inter-casing structure, the first sealing member 407*a* seals the gap "B" to prevent a leakage of urethane foam, which fills the space between the outer casing 402 and the inner casing 403.

The cabinet chassis 404 is mounted along the outer surface of the front edge of the outer casing 402. In the inter-casing structure according to the first embodiment shown in FIGS. 5 and 9A, a plurality of locking screws 4 are used to mount the cabinet chassis 404 to the front edge of the outer casing 402.

Figure 9B:
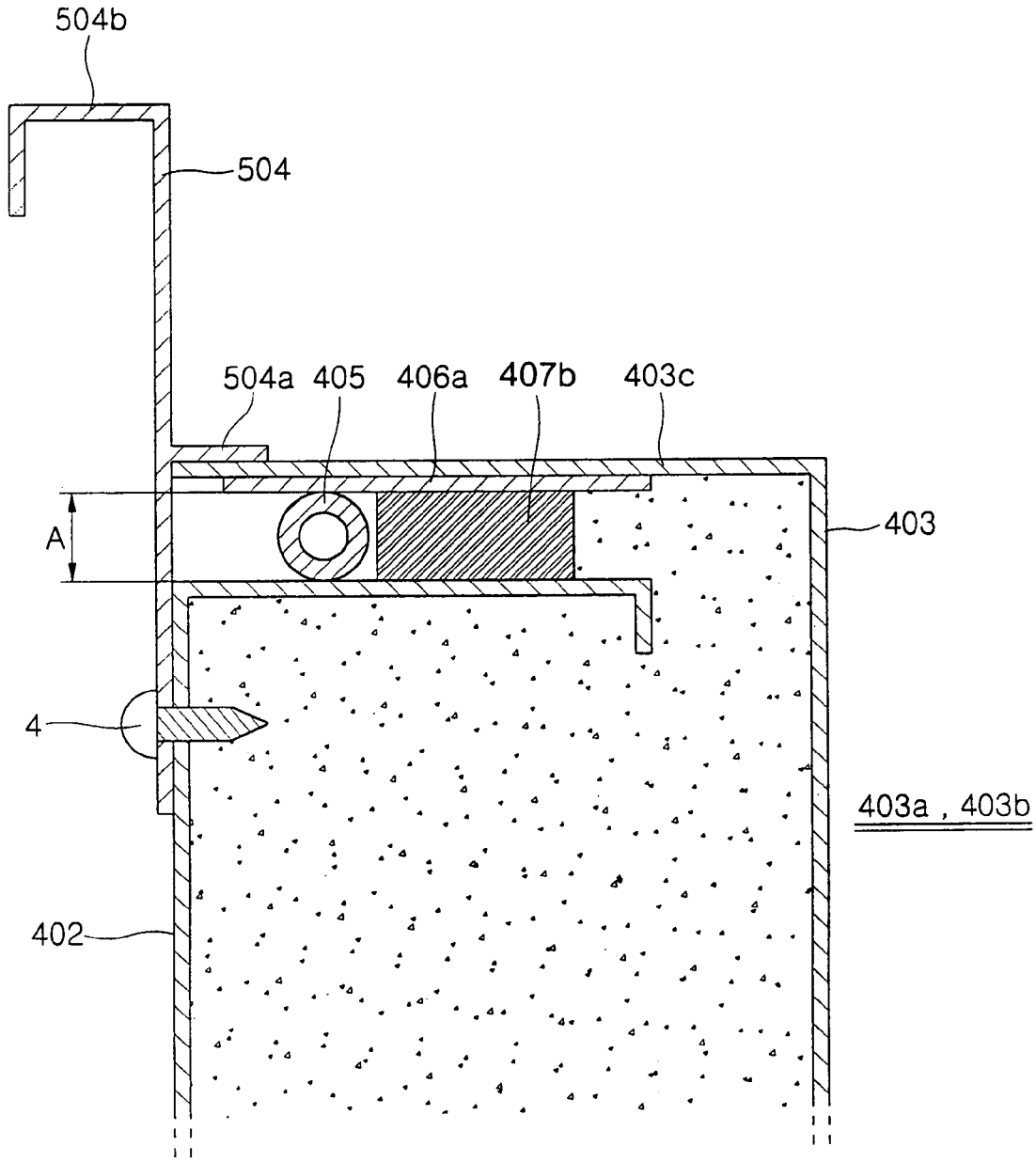
FIGS. 9B to 9D are sectional views of inter-casing structures, according to further embodiments of the present invention.

FIG. 9B is a sectional view of an inter-casing structure provided between the outer casing 402 and the inner casing 403, according to another embodiment of the present invention. As shown in the drawing, a thin magnetic panel 406*a* is mounted to an inner surface of the front flange 403*c* of the inner casing 403. A hot pipe 405 and a first sealing member 407*b* are provided along a gap "A" defined between the thin magnetic panel 406*a* and the support flange 402*a* of the outer casing 402. In the embodiment of FIG. 9B, the inter-casing structure uses the thin magnetic panel 406*a*, in place of the magnet 406 of the first embodiment of FIG. 9A. That is, the thin magnetic panel 406*a* allows the two doors (not shown) having magnets, to be magnetically attracted to the front flange 403*c* of the inner casing 403, so that the two doors are magnetically closed to the front of the cabinet. The inter-casing structure according to the embodiment shown in FIG. 9B thus reduces the production cost of the cabinet. In the embodiment of FIG. 9B, the inter-casing structure uses the cabinet chassis 504 of FIG. 8B, in place of the cabinet chassis 404 of FIG. 9A.

Figure 9C:
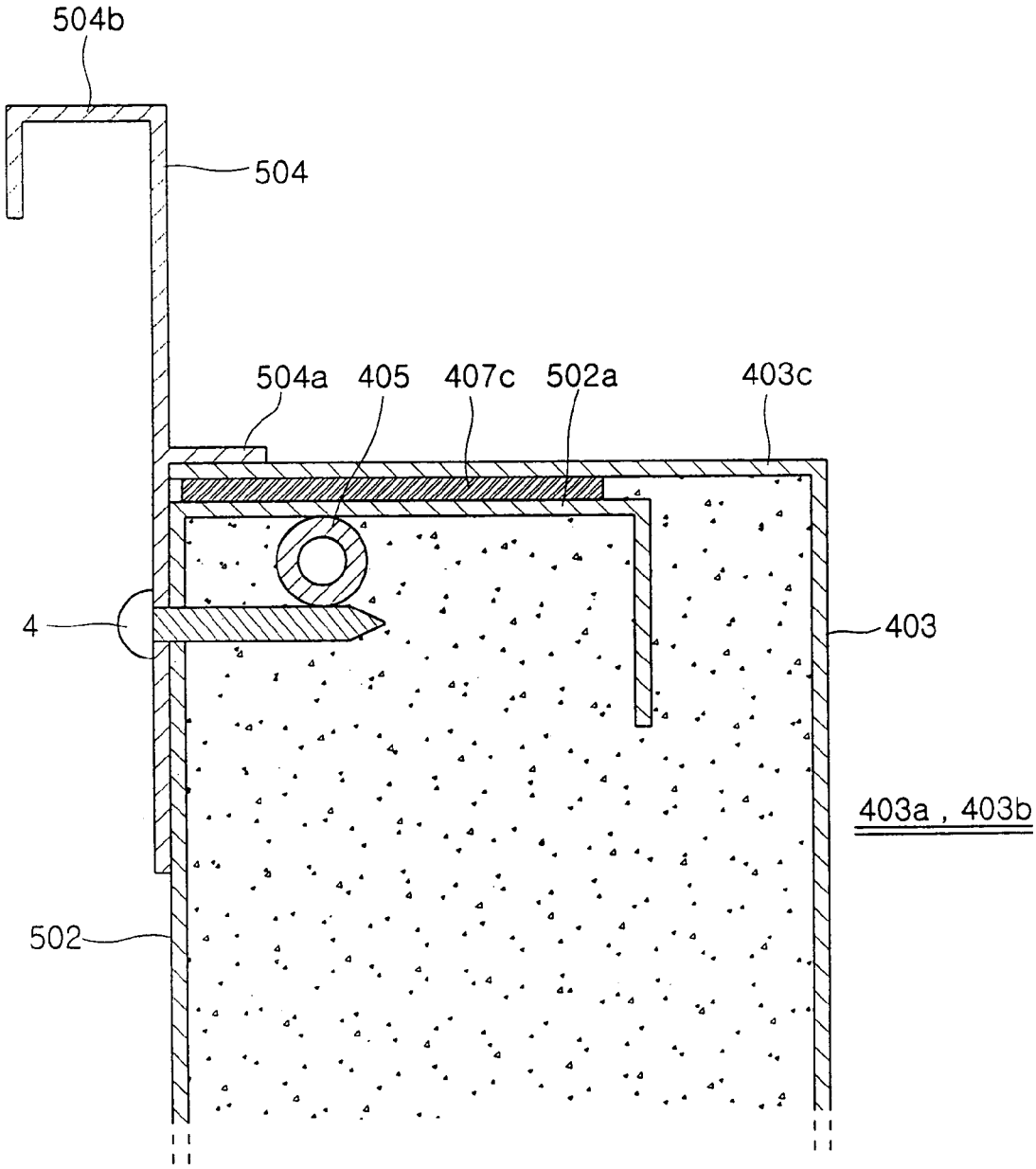

FIG. 9C is a sectional view of an inter-casing structure provided between an outer casing 502 and the inner casing 403, according to a further embodiment of the present invention. In the embodiment shown in FIG. 9C, a magnetic support flange 502*a*, in place of the support flange 402*a* of FIGS. 9A and 9B, extends from a front edge of an outer casing 502 toward the freezer and refrigerator compartments 403*a* and 403*b* of the inner casing 403 in back of the front flange 403*c* of the inner casing 403, with a thin sealing member 407*c* closely interposed between the front flange 403*c* of the inner casing 403 and the magnetic support flange 502*a* of the outer casing 502. The magnetic support flange 502*a* is made of a magnetic material to allow the two doors (not shown) having magnets, to be magnetically attracted to the front flange 403*c* of the inner casing 403. The two doors are thus magnetically closed to the front of the cabinet, due to the magnetic support flange 502*a*. Therefore, the inter-casing structure according to the embodiment shown in FIG. 9C reduces the production cost of the cabinet. In addition, a hot pipe 405 is closely arranged along an inner surface of the magnetic support flange 502*a* to prevent a formation of condensation at the front surface of the front flange 403*c*. In the embodiment shown in FIG. 9C, the inter-casing structure uses the cabinet chassis 504 of FIG. 8B, in place of the cabinet chassis 404 of FIG. 9A.

In the same manner as that described for the embodiment of FIG. 9B, the inter-casing structure according to the embodiment of FIG. 9C improves work efficiency during a cabinet assembly process, and reduces the production cost of the cabinet, since a part of the outer casing 502, in place of the separate magnet 406 of the first embodiment, is used to magnetically close the doors to the front of the cabinet.

Figure 9D:
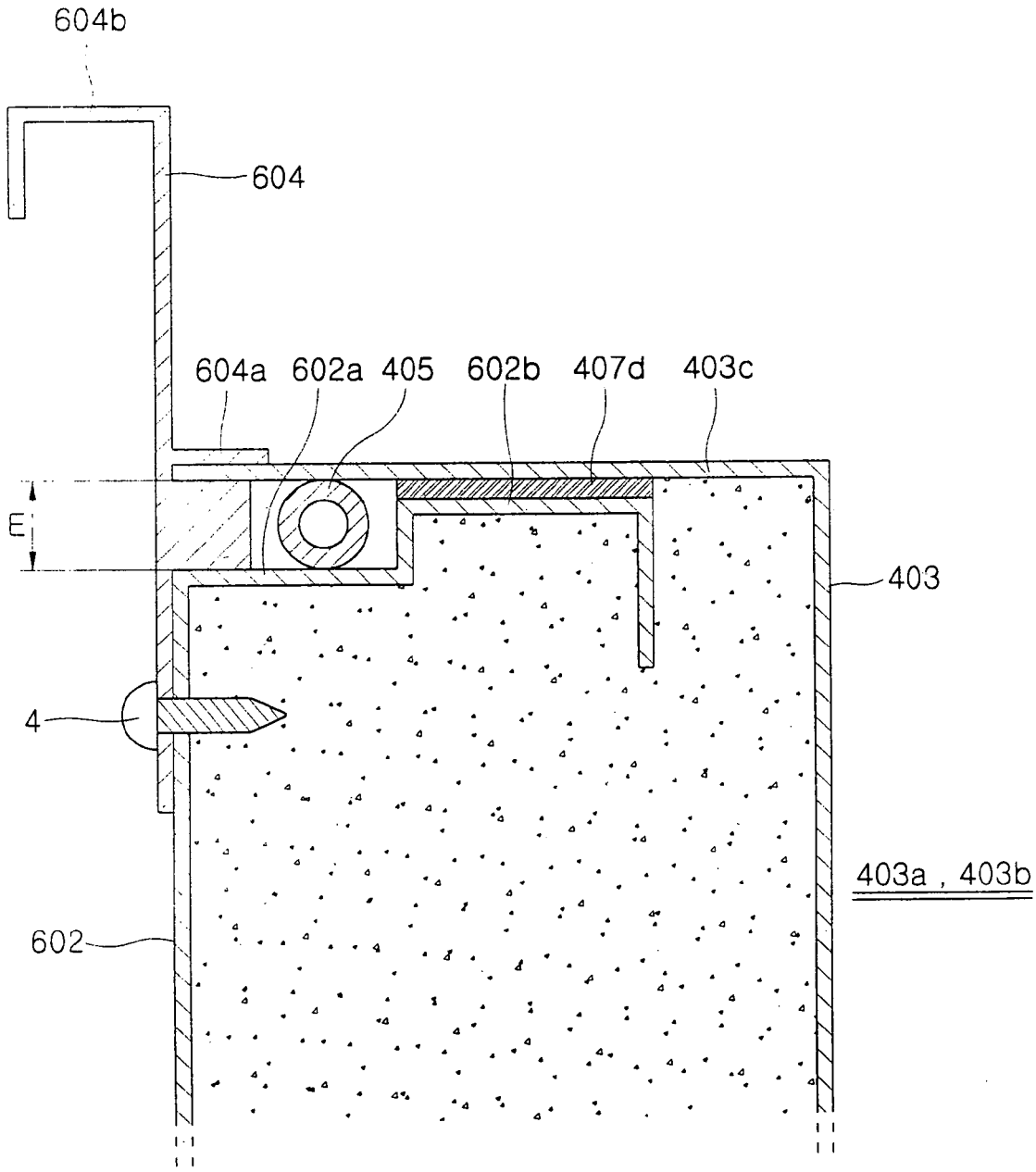

FIG. 9D is a sectional view of an inter-casing structure provided between an outer casing 602 and the inner casing 403, according to still another embodiment of the present invention. In the embodiment shown in FIG. 9D, an outer casing 602 has a support flange 602*a* that extends perpendicularly from a front edge of the outer casing 602 toward the freezer and refrigerator compartments 403*a* and 403*b* of the inner casing 403 in back of the front flange 403*c* of the inner casing 403, with a parallel gap "E" defined between the front flange 403*c* and the support flange 602*a*. The support flange 602*a* is also bent toward the front flange 403*c* of the inner casing 403, and is, thereafter, bent toward the freezer and refrigerator compartments 403*a* and 403*b* of the inner casing 403, thus forming a doubly bent part 602*b*. The doubly bent part 602*b* is made of a magnetic material.

In addition, a hot pipe 405 is arranged along the gap "E" defined between the support flange 602*a* of the outer casing 602 and the front flange 403*c* of the inner casing 403, such that the hot pipe 405 is supported by the support flange 602*a*. In the same manner as that described for the embodiment shown in FIG. 9C, a thin sealing member 407*d* is closely interposed between the front flange 403*c* of the inner casing 403 and the doubly bent part 602*b* of the outer casing 602.

In the embodiment shown in FIG. 9D, the inter-casing structure uses a cabinet chassis 604 having a structure different from that of the cabinet chassis 404 or 504. The cabinet chassis 604 is structured to finish both the front flange 403*c* of the inner casing 403 and the front edge of the outer casing 602, and plug the gap "E" defined between the support flange 602*a* of the outer casing 602 and the front flange 403*c* of the inner casing 403. The cabinet chassis 604 has a stop flange 604(*a*), and a doubly bent part 604(*b*).

Figure 10A:
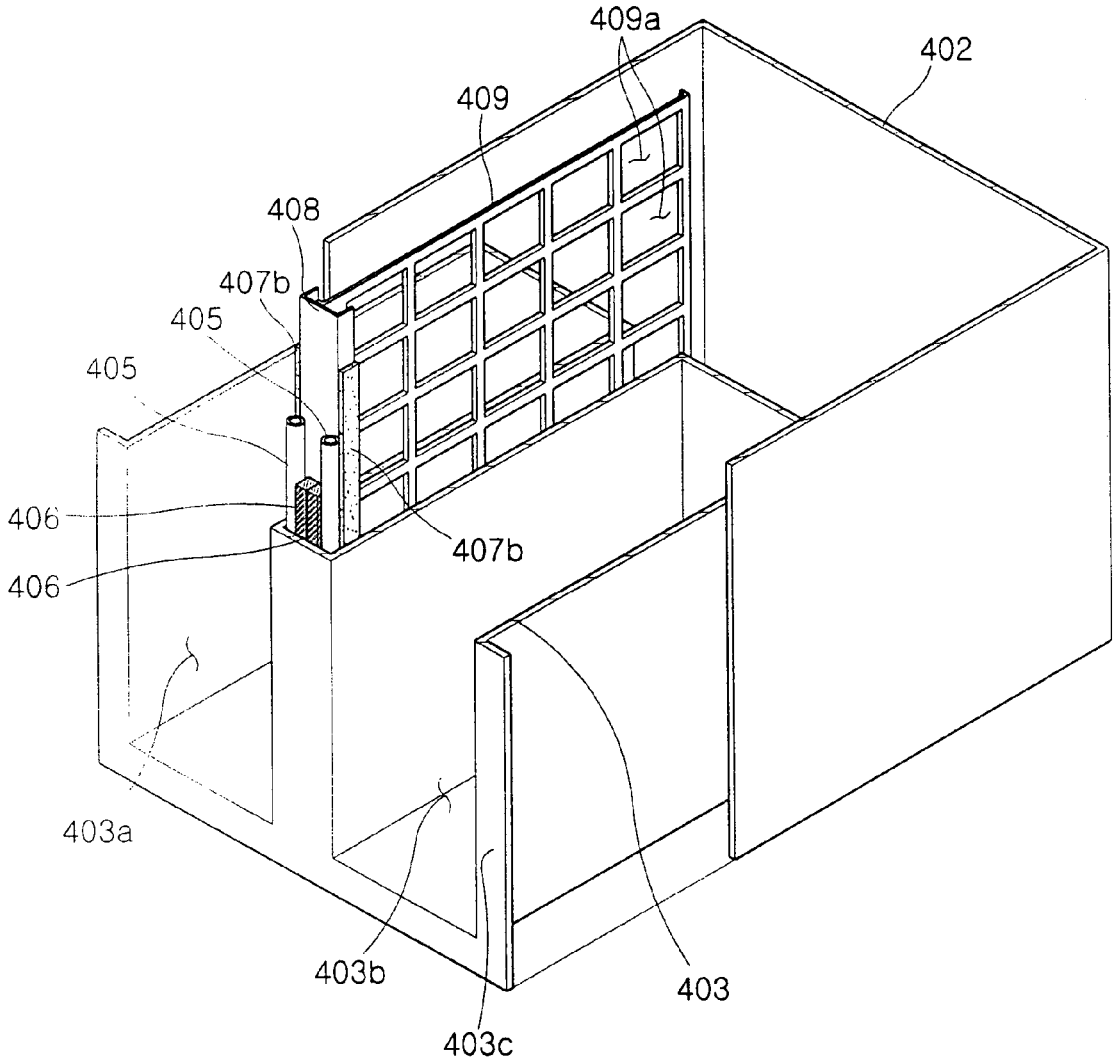
FIG. 10A is a partially broken perspective view of the cabinet of FIG. 4, which shows a partition wall structure of the cabinet.
Figure 10B:
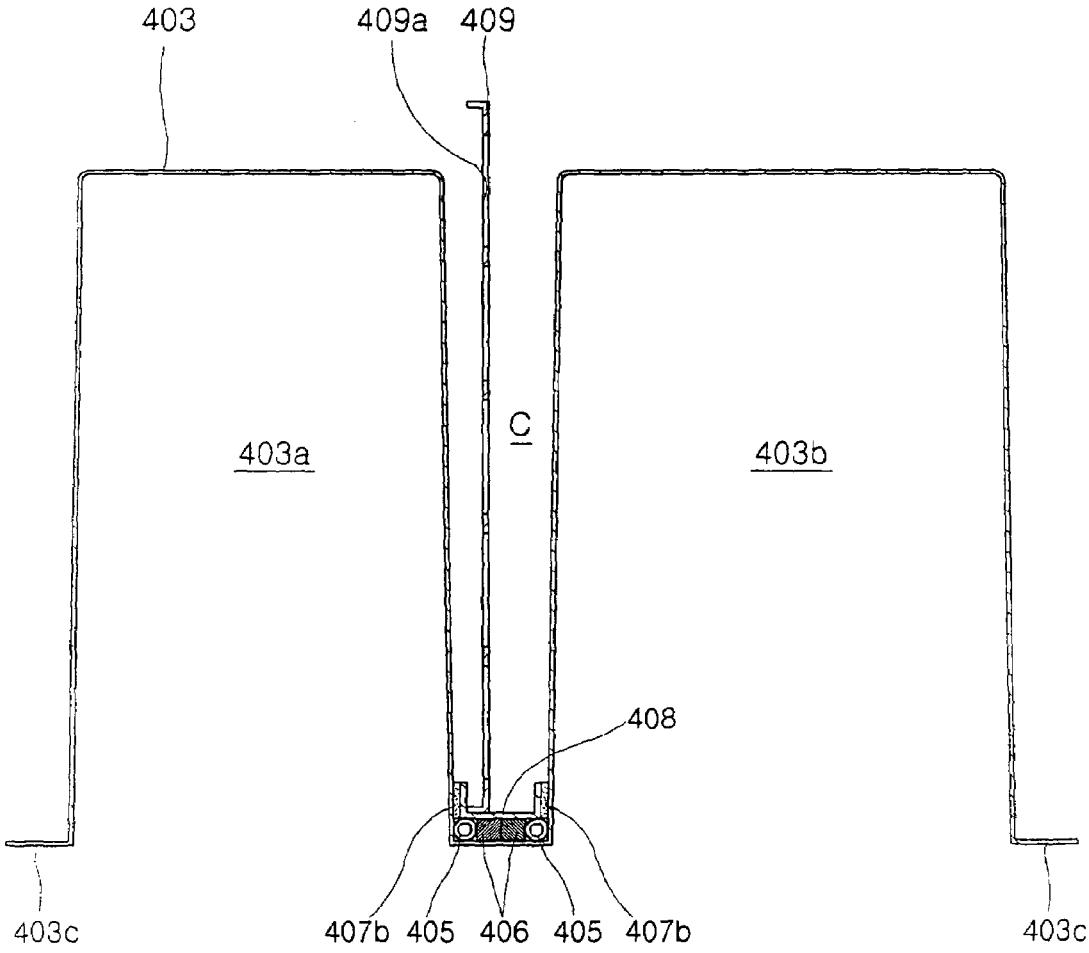
FIG. 10B is a latitudinal sectioned view of the cabinet of FIG. 10A to show the partition wall structure.

FIG. 10A is a partially broken perspective view of the cabinet of FIG. 4 to show the partition wall structure of the cabinet. FIG. 10B is a latitudinal sectioned view of the cabinet of FIG. 10A to show the partition wall structure.

As shown in the drawings, the partition wall structure includes the hot pipes 405, the magnets 406, the support member 408, the second sealing members 407*b*, and the support panel 409, which are located in the partition wall "C". That is, the hot pipes 405 and the magnets 406 are arranged in back of the front end surface of the partition wall "C". The hot pipes 405 prevent the formation of condensation at the front end surface of the partition wall "C", while the magnets 406 allow the two doors (not shown) to be magnetically attracted to the front end surface of the partition wall "C", so that the two doors are magnetically closed to the front end surface of the partition wall "C". The support member 408 is vertically installed in the partition wall "C" at the position in back of the hot pipes 405 and the magnets 406, thus supporting both the hot pipes 405 and the magnets 406 in the partition wall "C". The second sealing members 407*b* are interposed between each side edge of the support member 408 and the inner casing 403 to seal the junction between the support member 408 and the inner casing 403. The support panel 409 is vertically installed in the partition wall "C" at the position between the rear surface of the support member 408 and the inner surface of the outer casing 402, thus supporting the support member 408 in the partition wall "C".

The support panel 409 has a plurality of openings 409*a* to intercept heat transferred from the hot pipe 405 to the support panel 409 through the support member 408. The openings 409*a* of the support panel 409 also allow space on either side of the partition wall "C", which is separated by the support panel 409, to communicate through the openings 409*a*, thus allowing the urethane foam to smoothly flow from one side to the other side inside the partition wall "C" through the openings 409*a* during a process of filling the urethane foam in the interior of the partition wall "C".

According to one aspect, the support panel 409 is placed in the partition wall "C" at a position eccentric to the partition wall toward the freezer compartment 403*a*, which has a temperature lower than that of the refrigerator compartment 403*b*, as shown in FIG. 10B. The eccentric arrangement of the support panel 409 reduces heat transferred from the support panel 409 to the refrigerator compartment 403*b*, thus reducing a formation of condensation on a surface of the partition wall "C", which faces the refrigerator compartment 403*b*. In such a case, the freezer compartment 403*a* maintains a low temperature of 20 degrees below zero, so that it is possible to prevent a formation of condensation on a surface of the partition wall "C", which faces the freezer compartment 403*a*, even though the support panel 409 is eccentric to the partition wall toward the freezer compartment 403*a*.

The construction of the machine room 401 provided at the top of the cabinet according to the present invention will be described herein below, with reference to FIGS. 11A and 11B.

Figure 11A:
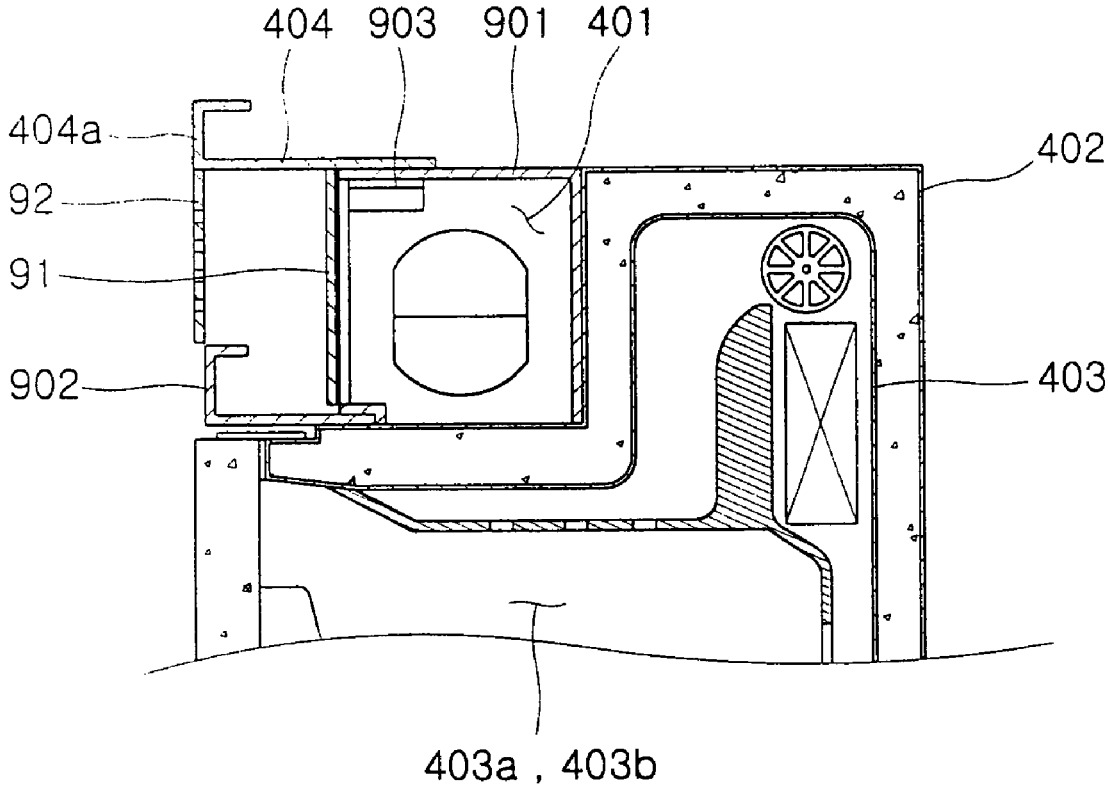
FIG. 11A is a side sectional view of a machine room provided at a top of the cabinet of FIG. 4.

FIG. 11A is a side sectional view of the machine room 401 of FIG. 4. FIG. 11B is a front view of the machine room 401 of FIG. 4. As shown in the drawings, a top of the outer casing 402 of the cabinet is stepped to form a lower step at a front area thereof, so that the machine room 401 is defined on the lower step by a cover housing 901 which is mounted on the lower step. The cover housing 901 is open at a front thereof. A noise panel 91 is mounted to the open front of the cover housing 901 to attenuate operational noise transmitted from the machine room 401 to the outside, while a machine room door 92 is provided in front of the noise panel 91 to open and close the machine room 401. In addition, the cabinet chassis 404 is mounted around front edges of the machine room 401 and the outer casing 402, to finish the front appearance of the refrigerator 400. In such a case, the cabinet chassis 404 is mounted along outer surfaces of the outer casing 402 and the cover housing 901. An intermediate chassis 902 is horizontally provided to finish the front of a space defined between the cover housing 901 and the freezer and refrigerator compartments 403*a* and 403*b*. The intermediate chassis 902 is interposed, at a first end thereof, between the cover housing 901 and the top of the outer casing 402, and is bent at a second end thereof toward a lower edge of the cover housing 901 to cover the lower edge of the cover housing 901.

According to one aspect (not shown), the cabinet chassis 504 of FIG. 8B is used in place of the above-mentioned cabinet chassis 404, to finish the front appearance of the refrigerator 400, which is recessed in the recess of the wall 40. In such a case, the cabinet chassis 504 has the stop flange 504*a*, which is positioned along the inner surface of the cabinet chassis 504 to support both the front of the cover housing 901 and the front flange 403*c* of the inner casing 403. The stop flange 504*a* thus prevents both the front of the cover housing 901 and the front flange 403*c* of the inner casing 403 from being thrust forward or deformed. The cabinet chassis 504 also has the doubly bent part 504*b* which covers the gap between the cabinet and the wall 40.

Figure 11B:
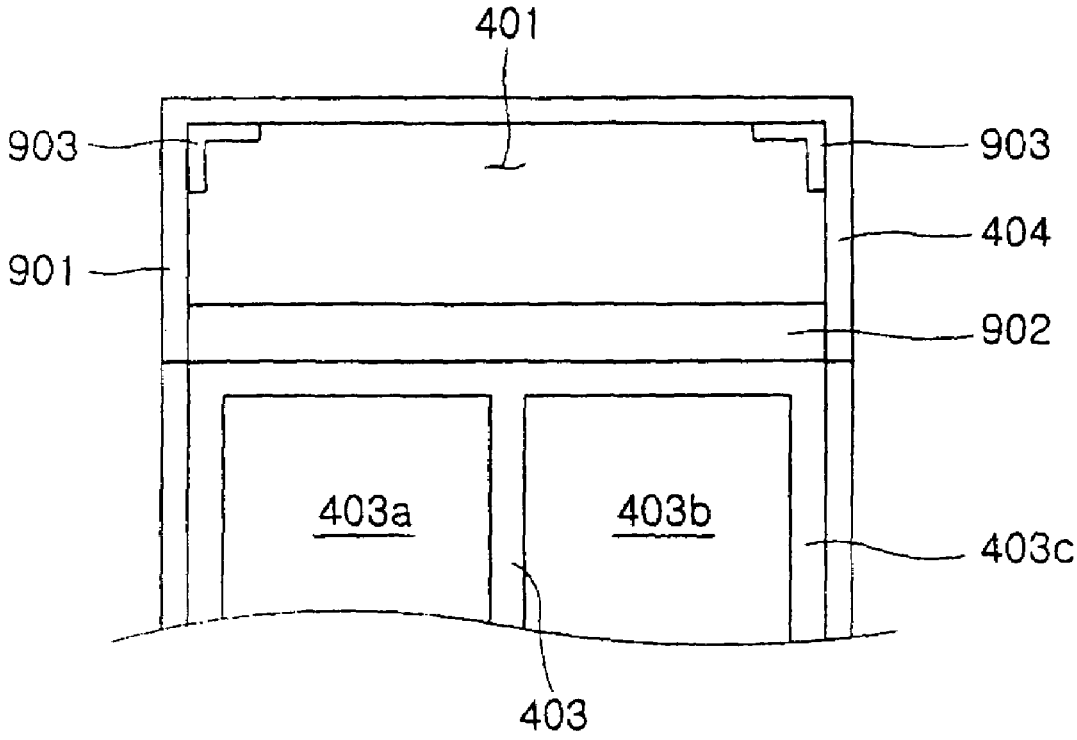
FIG. 11B is a front view of the machine room of FIG. 11A.

The cabinet chassis 404 is mounted to the cover housing 901 by use of an L-shaped bracket 903 provided at each of two front corners of the cover housing 901, as shown in FIG. 11B.

As is apparent from the above description, the present invention provides a cabinet for recessed side-by-side refrigerators, which has an integrated single inner casing to define a freezer compartment and a refrigerator compartment therein, and other elements that are structured to be suitable to the integrated single inner casing. The cabinet of the present invention is advantageous as follows, due to the integrated single inner casing and the other elements structured to be suitable to the integrated single inner casing.

First, due to the integrated single structure of the inner casing, the inner casing is free from any step, any gap or any assembled junction. The cabinet is provided with the cabinet chassis to finish the front appearance of the cabinet, so that the front appearance of the cabinet is improved, resulting in an improvement in the quality of the cabinet. The cabinet chassis also reduces a leakage of cool air from the cabinet to the atmosphere, thus reducing the power consumption.

Second, the integrated single structure of the inner casing simplifies the process of assembling the cabinet, thus improving productivity while assembling the cabinet.

Third, due to the integrated single structure of the inner casing, the number of the elements of the cabinet is reduced. Efficiency of production of cabinets for the recessed side-by-side refrigerators is thus improved, and a light and stable structure of the cabinets is accomplished.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cabinet for recessed refrigerators, comprising:

an outer casing to define an appearance of the cabinet, the outer casing being a box-shaped body open at a front thereof;

an integrated single inner casing installed in the outer casing, with a predetermined space defined between the inner and outer casings, the integrated single inner casing defining therein at least two storage compartments open at fronts thereof, with a partition wall between the at least two storage compartments to maintain a predetermined gap between the storage compartments;

a support panel disposed within the partition wall and contacting and supporting the outer casing;

at least one partition wall structure provided in back of a front end surface of the partition wall; and a support member installed in the partition wall at a position in back of the at least one partition wall structure to support the partition wall structure, wherein the support panel contacts and supports the support member, and wherein the support panel is installed at a position between a rear surface of the support member and an inner surface of a rear wall of the outer casing.

2. The cabinet according to claim 1, wherein the inner casing comprises:

a front flange that extends from a front edge of the inner casing toward a front edge of the outer casing to cover a front of the space defined between the inner and outer casings.

3. The cabinet according to claim 1, wherein the at least one partition wall structure comprises a hot pipe.

4. The cabinet according to claim 1, wherein the at least one partition wall structure comprises at least one magnet or at least one magnetic member made of magnetic material.

5. A cabinet for recessed refrigerators, comprising:

an outer casing to define an appearance of the cabinet, the outer casing being a box-shaped body open at a front thereof;

an integrated single inner casing installed in the outer casing, with a predetermined space defined between the inner and outer casings, the integrated single inner casing defining therein at least two storage compartments open at fronts thereof, with a partition wall formed between the at least two storage compartments to maintain a predetermined gap between the storage compartments;

at least one partition wall structure provided in the partition wall adjacent to a front end surface of the partition wall;

a support member installed in the partition wall at a position adjacent to the partition wall structure to support the at least one partition wall structure; and a support panel positioned within the partition wall to contact and support the support member and an inner surface of a rear wall of the outer casing.

6. The cabinet according to claim 5, wherein the support panel comprises:

at least one opening.

7. The cabinet according to claim 5, wherein:

the support panel is placed in the at least one partition wall at a position eccentric to the at least one partition wall, nearer to one of the at least two storage compartments, which has a lower temperature.

8. The cabinet according to claim 5, wherein the at least one partition wall structure comprises:

at least one of a hot pipe and a magnet.

9. A cabinet for recessed refrigerators, comprising:

an outer casing to define an appearance of the cabinet, the outer casing being a box-shaped body open at a front thereof;

an integrated single inner casing installed in the outer casing, with a predetermined space defined between the inner and outer casings, the integrated single inner casing defining therein at least two storage compartments open at fronts thereof, with a partition wall formed between the at least two storage compartments to maintain a predetermined gap between the storage compartments;

at least one partition wall structure provided in the partition wall adjacent to a front end surface of the partition wall;

a support member installed in the partition wall at a position adjacent to the partition wall structure to support the partition wall structure;

a support panel to support the support member, provided in the predetermined space defined between the inner and outer casings, adjacent to the partition wall structure at a first end of the support panel, and adjacent to the outer casing at a second end of the support panel; and at least one sealing member provided between the support member and the inner casing preventing insulation disposed between the inner and outer casings from contacting the partition wall structure.

10. The cabinet according to claim 9, wherein the at least one partition wall structure comprises:

at least one of a hot pipe and a magnet.

* * * * *